US006543407B1

(12) United States Patent
Maier et al.

(10) Patent No.: US 6,543,407 B1
(45) Date of Patent: Apr. 8, 2003

(54) METHOD FOR DOSING FUEL WITH A FUEL INJECTION VALVE

(75) Inventors: Martin Maier, Moeglingen (DE); Guenther Hohl, Stuttgart (DE); Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/857,713

(22) PCT Filed: Oct. 5, 2000

(86) PCT No.: PCT/DE00/03495

§ 371 (c)(1),
(2), (4) Date: Nov. 5, 2001

(87) PCT Pub. No.: WO01/25619

PCT Pub. Date: Apr. 12, 2001

(30) Foreign Application Priority Data

Oct. 7, 1999 (DE) ..... 199 48 237

(51) Int. Cl.[7] ..... F02M 61/16
(52) U.S. Cl. ..... 123/295; 123/305
(58) Field of Search ..... 123/295, 305, 123/294, 296, 297, 298, 299, 300–304

(56) References Cited

U.S. PATENT DOCUMENTS 4,401,071 A * 8/1983 Zurner et al. ..... 123/295
5,163,621 A 11/1992 Kano et al.
5,299,919 A 4/1994 Paul et al.
5,392,745 A * 2/1995 Beck ..... 123/295
5,865,153 A * 2/1999 Matsumoto ..... 123/305
6,257,197 B1 * 7/2001 Nishimura et al. ..... 123/295
6,269,790 B1 * 8/2001 Yi et al. ..... 123/295

FOREIGN PATENT DOCUMENTS

DE 196 26 576 1/1998
DE 198 14 693 10/1998
JP 11 257 182 9/1999

* cited by examiner

*Primary Examiner*—Paul J. Hirsch
(74) *Attorney, Agent, or Firm*—Kenyon & Kenyon

(57) ABSTRACT

The invention relates to a process for metering fuel with a fuel injector (1), in particular an injector for fuel injection systems of internal combustion engines. The fuel injector has an actuator (14) and a valve closing body (6) which can be activated by the actuator (14) to produce a valve stroke, and the valve closing body cooperates with a valve seat face (5) to form a sealing seat. The valve closing body (6) and/or valve seat face (5) has at least one swirl element (27; 41) to produce a swirling flow. In order to vary the fuel distribution of fuel injected by the fuel injector (1), the valve stroke triggered by the actuator (14) has a variable opening speed, whereby a transition from an at least approximately swirl-free preliminary flow of the injected fuel to a swirling flow of the injected fuel is produced by varying the opening speed.

10 Claims, 2 Drawing Sheets

METHOD FOR DOSING FUEL WITH A FUEL INJECTION VALVE

FIELD OF THE INVENTION

The present invention relates to a process for metering fuel with a fuel injector.

BACKGROUND INFORMATION

German Published Patent Application No.196 26 576 describes a process and a fuel injector that has a solenoid armature and a solenoid coil which form, together with the housing of the fuel injector, a magnetic flux circuit. When the coil is actuated, the armature is pulled into the coil, which lifts a valve closing body connected with the armature off of a valve seat face, and fuel is ejected out of the fuel injector. To improve the swirling of the ejected fuel, the valve closing body has swirl grooves formed in it that produce a swirling flow.

To meter fuel with the fuel injector disclosed by German Published Patent Application No.196 26 576, an excitation voltage is applied to the magnetic coil, whereby the metered quantity of fuel is varied from when the excitation voltage is turned on to when it is turned off.

The disadvantage of the prior-art fuel injector disclosed by German Published Patent Application No.196 26 576 is that the properties of the ejected fuel jet are determined by the design, so that only the metered quantity of fuel can be changed and not the distribution of the fuel in the combustion chamber into which the fuel is injected.

Another disadvantage is that a change in the jet field of ejected fuel requires a change in the manufacturing process of the fuel injector, so that differing customer requirements can only be met to a limited extent.

SUMMARY OF THE INVENTION

By contrast, the process according to the present invention for metering fuel with a fuel injector has the advantage that the properties and thus the pattern of the ejected fuel jet can be varied without changing the design of the fuel injector so that the fuel distribution of the fuel ejected by the fuel injector can be changed while operating the injector. Moreover, the fuel injector covers a greater range of application, which improves engine behavior.

It is advantageous for the valve stroke to have a low opening speed so that the transition from the preliminary flow (which is at least approximately free of swirl) to the swirling flow is essentially continuous, and the fuel ejected near the ejection end of the fuel injector has an at least approximately uniform distribution. The strong stroke throttling of the initial flow in which the valve has just opened with an early overlapping swirling flow gives the fuel a low speed; this distributes the fuel essentially near the ejection end of the fuel injector. This allows the fuel to accumulate, e.g., in the area of a spark plug, and to be uniformly distributed there so that the fuel advantageously ignites even if there is only a small quantity. Moreover, this process is especially suitable for small combustion chambers in which a strong jet penetration is undesired to prevent wetting an inside wall of a combustion chamber of the internal combustion engine or one of its pistons.

It is advantageous that: The valve stroke occurs with a high opening speed so that the approximately swirl-free preliminary flow produces a slender, tubular, preliminary jet; that the transition from the (at least approximately) swirl-free preliminary flow to the swirling flow is essentially abrupt; and that the swirling flow produces a conical, broad, main jet following the slender, tubular, preliminary jet. This distributes the injected fuel over a large volume, whereby the fuel jet produced by the preliminary flow has a high speed in the injection direction, and the fuel flow produced by the swirling flow has a high velocity component perpendicular to the injection direction.

It is advantageous that the opening speed is varied by changing the opening time of an essentially constant valve stroke. The "opening time" is the time required to open the fuel injector. This makes it especially simple to use the process.

It is advantageous that the fuel is injected directly into a combustion chamber of an external-ignition internal combustion engine, and that the opening speed is affected by the mode of operation of the internal combustion engine. One can produce the jet pattern desired for the respective operating point to optimize the operational behavior of the internal combustion engine by specifically controlling the fuel injector while the internal combustion engine is operating.

It is also advantageous for the valve stroke to have a low opening speed when the internal combustion engine is in stratified-charge operation, and for the valve stroke to have a high opening speed when the internal combustion engine is in homogenous operation. When the internal combustion engine is in stratified-charge operation, the fuel collects mainly in the area of a spark plug for superior fuel ignition. When the internal combustion engine is in homogenous operation, the fuel is distributed throughout the combustion chamber to optimally mix the fuel with the available air sucked into the internal combustion engine for optimal combustion.

DETAILED DESCRIPTION

Figure 1:
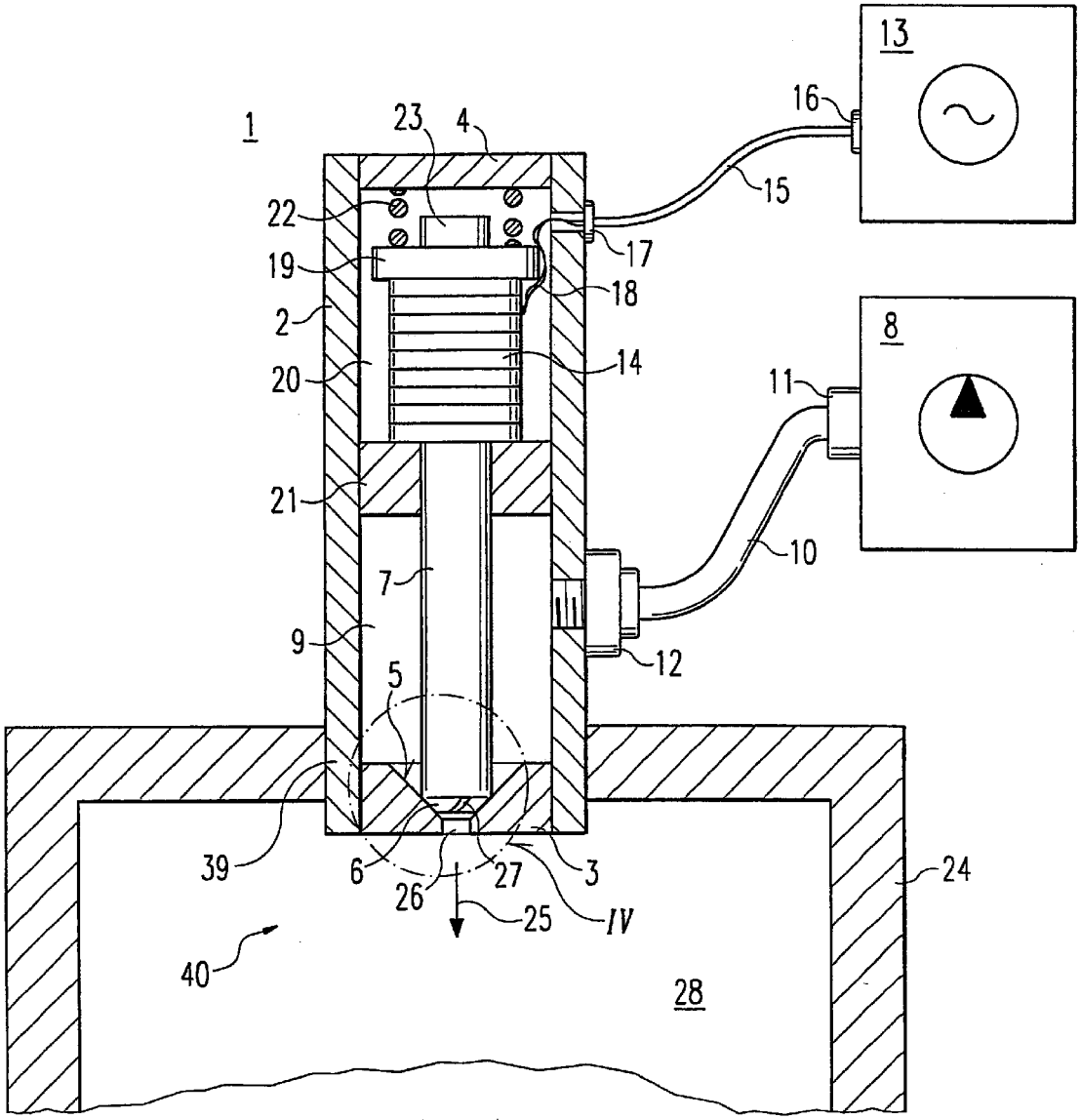
FIG. 1 shows an axial section through a fuel injector to explain the process according to the present invention.

FIG. 1 shows a partial axial section of a fuel injector 1. The fuel injector 1 is used especially as a gasoline direct injection valve for directly injecting fuel, especially gasoline, into a combustion chamber of a mixture-compressing, external-ignition internal combustion engine. The fuel injector 1 in this sample embodiment is designed as an internally-opening fuel injector 1. However, the fuel injector 1 is also suitable for other uses. Fuel injector 1 has a valve housing 2, a valve seat body 3 connected with the housing on the injection side, and a sealing plate 4 connected with the valve housing 2 on the end facing away from the injection side. Valve seat body 3 has a valve seat face 5, which cooperates with a valve closing body 6 to form a sealing seat. Valve closing body 6 is actuated by a valve needle 7, which is made as a single piece with valve closing body 6 in the sample embodiment shown.

Fuel injector 1 is connected with a fuel pump 8 which conveys fuel into a fuel chamber 9 inside valve housing 2 and applies pressure to the chamber. Fuel pump 8 is connected with valve housing 2 of fuel injector 1 via a fuel line 10, which is connected with fuel pump 8 by a connector 11 and with fuel injector 1 by a connector 12, which, e.g., is screwed into valve housing 2 of fuel injector 1. Moreover, fuel injector 1 is connected with a control circuit 13 to produce an electric signal to trigger an actuator 14, whereby the connection comprises an electric lead 15, connectors 16, 17, and an electric supply lead 18.

In this sample embodiment, actuator 14 has a piezoelectric or magnetostrictive design. However, actuator 14 can also be designed as an electromagnet. Actuator 14 has a central recess through which valve needle 7 extends. Moreover, valve needle 7 is connected with a pressure plate 19, which lies against actuator 14. An actuator chamber 20 is sealed off from fuel chamber 9 by a guide element 21, which also guides valve needle 7 when valve closing body 6 is actuated. Actuator 14 lies against guide element 21 on one side and against pressure plate 19 on the other side. A compression spring 22,arranged in actuator chamber 20, which rests against closing plate 4 on one side and pressure plate 19 on the other side, acts upon actuator 14 with prepressure, and one end 23 of valve needle 7 guides compression spring 22. In this sample embodiment, fuel injector 1 is inserted into a cylinder head 24 of an internal combustion engine. To actuate fuel injector 1, an electric control signal from control circuit 13 is applied to actuator 14 to extend it and cause valve needle 7 to execute a stroke in the direction opposite that of the injection direction 25. This lifts valve closing body 6 off of valve seat face 5 of valve seat body 3 and causes fuel to flow from fuel chamber 9 through the resulting gap between valve closing body 6 and valve seat face 5 into an injection channel 26, and to be injected from injection channel 26 into a combustion chamber 28 of cylinder 24 of the internal combustion engine. Valve closing body 6 has at least one swirl groove 27 that forms a swirl element. This produces a swirling flow when fuel is injected from the fuel injector 1 which allows better preparation of the fuel.

Figure 4:
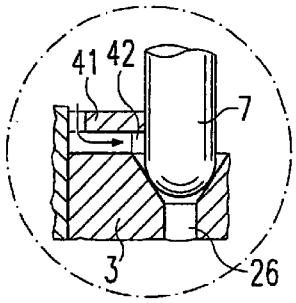
FIG. 4 shows an alternate design of section IV in FIG. 1.

As is shown in FIG. 4, a swirl element 41 can also be arranged according to an alternative design upstream from the sealing seat, e.g. as a washer-shaped swirl element 41 with tangential swirl channels 42.

The control signal produced by control circuit 13 determines the extension of actuator 14, and this can affect the opening speed of valve closing body 6. Here the opening speed is set by the time derivative of the travel of valve needle 7, which is equivalent to a stroke of valve closing body 6. When fuel injector is actuated, a swirling flow produced by the swirl element in the form of swirl groove 27 is not constant but depends on the opening motion of valve needle 7. Therefore, the injected fuel jet pattern is affected by varying the opening speed.

FIGS. 2A through 2C and FIGS. 3A and 3B show examples of the jet pattern of fuel injected from fuel injector 1 with a high opening speed and a low opening speed.

Figure 2A:
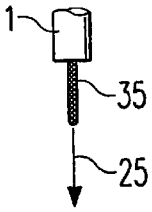
FIG. 2A shows the jet pattern of a first sample embodiment of the process according to the present invention with a high opening speed at time Dt.
Figure 2B:
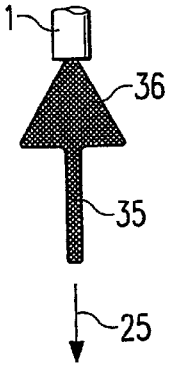
FIG. 2B shows the jet pattern of the first sample embodiment of the process according to the present invention with a high opening speed at the time 2Dt.
Figure 2C:
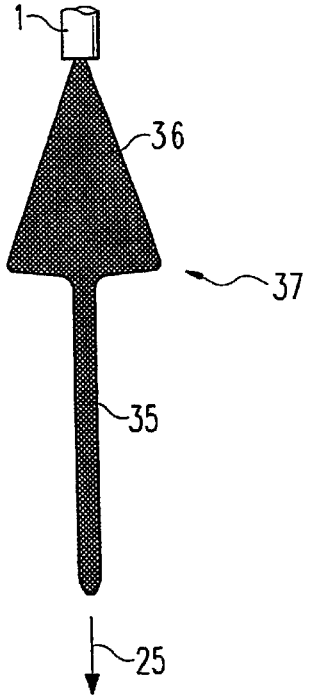
FIG. 2C shows the jet pattern of the first sample embodiment of the process according to the present invention with a high opening speed at time 5Dt.

FIGS. 2A through 2C show the jet pattern of fuel injected from fuel injector 1 with a valve stroke triggered by actuator 14 at a high opening speed.

FIG. 2A shows the jet pattern of fuel injected at time Dt after the start of opening. In this sample embodiment, fuel injector 1 is already completely open at this point in time. The high pressure of the fuel in fuel chamber 9 causes the fuel to be injected at a high speed out of fuel injector 1 essentially in the injection direction 25; swirl element 27 of fuel injector 1 is at first does not influence the flow of fuel so that a preliminary flow arises that is at least approximately swirl-free and produces a slender, tubular preliminary jet 35.

FIG. 2B shows the jet pattern of fulel injected from fuel injector 1 at time 2Dt after the opening of fuel injector 1. The slender, tubular preliminary jet 35 has moved further in the injection direction 25 due to its high speed in the injection direction 25, and is lengthened in the injection direction 25 due to a varying speed distribution in the preliminary jet 35. The transition from the (at least approximately) swirl-free preliminary flow (which produces the preliminary jet 35) to a swirling flow produced by the swirl elements 27 is essentially abrupt and produces a uniform, conical main jet 36 which abruptly follows the slender, tubular, preliminary jet 35. The conical shape of the main jet 36 at a maximum width is because the swirling flow gives the fuel a velocity component that is oriented perpendicular to the injection direction 25, and the swirling flow is also somewhat throttled by the swirl elements.

FIG. 2C shows the jet pattern of fuel injected from fuel injector 1 at time 5Dt after the fuel injector 1 opens. The high speed of the preliminary jet 35 oriented in the injection direction means that it has already covered a great distance in space. The fulel in the main jet 36 has velocity components perpendicular to the injection direction 25 so that the main jet 36 widens in the injection direction 25 to give the area 37 of the main jet 36 a large diameter.

In the process according to the present invention for metering fulel using a fuel injector 1, the fuel injected from the fulel injector 1 can be spread over a wide space by selecting a high opening speed as shown in FIGS. 2A through 2C.

Figure 3A:
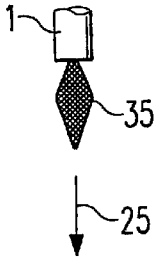
FIG. 3A shows the jet pattern of a second sample embodiment of the process according to the present invention with a low opening speed at time 2Dt.
Figure 3B:
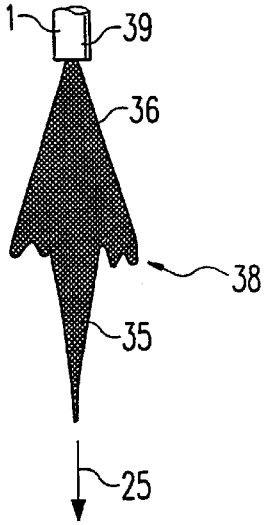
FIG. 3B shows the jet pattern of the second sample embodiment of the process according to the present invention with a low opening speed at time 5Dt.

FIGS. 3A and 3B show a second sample embodiment of the process according to the present invention in which the stroke of valve needle 7 has a low opening speed.

FIG. 3A shows the jet pattern of the fuel injected by fuel injector 1 at time 2 Δt after the opening of fuel injector 1. In this sample embodiment, fuel injector 1 is completely open at approximately this point. Since fuel injector 1 in this sample embodiment opens at approximately half the speed as in the first sample embodiment (FIGS. 2A through 2C), there is a different flow pattern. The slow opening strongly throttles the liquid in the sealing seat between the exit of the swirl channels 27 and the seat. Simultaneously, overlap with the forming swirling flow produces a mixed flow which has less swirl than a pure swirling flow (see FIGS. 2A–2C). This makes the spray less elongated in the injection direction 25 and also keeps it from widening as much in the radial direction in area 38 than in the cases shown in FIGS. 2B, 2C.

FIG. 3B shows the jet pattern of fuel injected by fuel injector 1 at time 5 Δt after the opening of fulel injector 1. Preliminary jet 35 has covered a smaller distance in space, due to its internal speed, than the preliminary jet 35 of the first sample embodiment (FIG. 2C). Moreover, the transition from preliminary jet 35 to the main jet 36 is continuous, and the jet pattern in this sample embodiment is not uniform in area 38. Here the jet pattern has a smaller diameter in area 38 than the jet pattern in the first sample embodiment (FIG. 2C) does in area 37.

If the process for metering fuel with a fuel injector 1 follows the second sample embodiment, then the injected fuel has a distribution that is at least approximately uniform in an injection area 40 near an injection end 39 of fuel injector 1.

Therefore the jet pattern of the injected fuel, especially its elongation, is adjusted in the process according to the present invention by varying the opening speed, as is exemplified in FIGS. 2A through 2C and FIGS. 3A and 3B. Varying the control signal produced by control circuit 13 can produce the jet pattern desired for the respective operating point while operating fulel injector 1. Therefore the process according to the present invention is able to produce variable fulel distribution as shown, for example, in FIGS. 2C and 3B, as a function of the mode of operation of fuel injector 1 by varying the opening speed.

The present invention is not limited to the sample embodiments described. In particular, the present invention can also be applied in magnetically actuated fuel injectors, where appropriate flow guidance can control the accumulation of force that is necessary.

What is claimed is:

1. A process for metering a fuel with a fuel injector including an actuator, a valve closing body that can be activated with a valve stroke by the actuator and that cooperates with a valve seat face to form a sealing seat, and at least one swirl element for producing a swirling flow and arranged near the valve seat face, comprising the steps of:

providing a variable opening speed to the valve stroke triggered by the actuator in order to produce a variable fuel distribution of the fuel ejected by the fuel injector; and varying the variable opening speed to produce a transition from an at least approximately swirl-free preliminary flow of the fuel ejected by the fuel injector to a swirling flow of the fuel ejected by the fuel injector.

2. The process according to claim 1, wherein:

the fuel injector corresponds to a fuel injector for a fuel injection system of an internal combustion engine.

3. The process according to claim 1, wherein:

the valve stroke has a low opening speed so that the transition from the at least approximately swirl-free preliminary flow to the swirling flow is essentially continuous, and the fuel ejected from the fuel injector is distributed at least approximately uniformly in an ejection area near an ejection end of the fuel injector.

4. The process according to claim 1, wherein:

the valve stroke has a high opening speed so that the at least approximately swirl-free preliminary flow produces a slender, tubular, preliminary jet, the transition from the at least approximately swirl-free preliminary flow to the swirling flow is essentially abrupt, and the swirling flow produces a conical main jet following the slender, tubular, preliminary jet.

5. The process according to claim 1, further comprising the step of:

varying the variable opening speed by varying an opening time with an essentially constant valve stroke.

6. The process according to claim 1, further comprising the step of:

directly injecting the fuel into a combustion chamber of an external-ignition internal combustion engine, wherein:

the variable opening speed is affected by an operating mode of the external-ignition internal combustion engine.

7. The process according to claim 6, wherein:

during a stratified-charge operation of the external-ignition internal combustion engine, the variable opening speed of the valve stroke has a low magnitude, and during a homogeneous operation of the external-ignition internal combustion engine, the variable opening speed of the valve stroke has a high magnitude.

8. The process according to claim 1, further comprising the step of:

applying an electric control signal to the actuator, whereby the variable opening speed is affected by a size of a current of the electric control signal.

9. The process according to claim 1, wherein:

the at least one swirl element includes at least one swirl groove in at least one of the valve closing body and the valve seat face.

10. The process according to claim 1, wherein:

the actuator includes one of a piezoelectric actuator, a magnetostrictive actuator, and an electromagnetic actuator.

* * * * *